US005339472A

United States Patent [19]

Yin

[11] Patent Number: 5,339,472

[45] Date of Patent: Aug. 23, 1994

[54] INFANT HEAD AND NECK SUPPORT PILLOW

[76] Inventor: Helen Yin, 755 Hamilton Dr., Orlando, Fla. 32833

[21] Appl. No.: 77,746

[22] Filed: Jun. 18, 1993

[51] Int. Cl.[5] ..... A47C 16/00

[52] U.S. Cl. ..... 5/631; 5/655

[58] Field of Search ..... 5/636, 637, 655; 297/393

[56] References Cited

U.S. PATENT DOCUMENTS

| | | | |
|---|---|---|---|
| D. 316,793 | 5/1991 | Manjarrez | D6/595 |
| 2,336,707 | 12/1943 | Thompson | 5/636 |
| 3,312,987 | 4/1967 | Emery | 5/636 X |
| 4,345,347 | 8/1982 | Kantor | 5/636 X |
| 4,617,691 | 10/1986 | Monti et al. | 5/636 X |
| 4,726,085 | 2/1988 | Antonio | 5/636 X |
| 4,776,049 | 10/1988 | Perron | 5/436 |
| 4,779,930 | 10/1988 | Rosen | 297/464 |

FOREIGN PATENT DOCUMENTS

| | | | |
|---|---|---|---|
| 2379268 | 2/1977 | France | 5/655 |
| 838455 | 6/1964 | United Kingdom | 297/393 |
| 2198341 | 6/1988 | United Kingdom | 5/636 |

*Primary Examiner*—Michael F. Trettel
*Attorney, Agent, or Firm*—Michael K. Gray

[57] ABSTRACT

An infant head support pillow neck made of a filler-cushion material which is covered by a top half and bottom half which are sewn together. The top and bottom halves are identically shaped so as to give the infant pillow head support a substantially rectangular appearance. The shape of the infant head support pillow is defined by first and second latitudinal sides and first and second longitudinal sides, the longitudinal sides being longer in length than the latitudinal sides. The second longitudinal side has a first keyhole wing and a second keyhole wing which curve inward in the direction of the first longitudinal side to form an opening between them. The second longitudinal side extends from the first and second keyhole wings to form a keyhole region at the center of the pillow. The keyhole region has a diameter which is approximately one-fourth the distance between the first and second latitudinal sides. The pillow provides support while the infant is being held or carried by an individual as well as when using any commercially available baby product.

8 Claims, 2 Drawing Sheets

INFANT HEAD AND NECK SUPPORT PILLOW

BACKGROUND OF THE INVENTION

1. Field of the Invention

The present invention relates to pillows. More particularly the present invention pertains to a pillow designed for infants which safely supports the neck of an infant while allowing the infant's head to maintain an upright position in relation to the infant's spinal column.

2. Discussion of the Background

For the first few months of life, newborn infants have very weak neck muscles which are incapable of supporting the weight of their oversized heads. As such, newborns or infants do not have sufficient neck strength to support their heads in a given position for any length of time.

For example, when riding in a car, the slightest changes in the car's momentum such as when turning, when coming to a stop, and when accelerating can result in the spontaneous head movement of the infant which causes the infant to awaken before the time desired by the infant and its mother. Car seats are presently required to be worn by infants in all fifty states and are designed for safety and comfort. However, car seats do not provide any neck support whatsoever.

Due to the delicate and weak nature of a baby's neck, it is preferable that a support mechanism not be tied about the neck. Rather, a need is seen for a flexible and light-weight neck support which will conform to the baby 's neck and lend support therefor while maintaining the baby's head in an erect position.

SUMMARY OF THE INVENTION

Accordingly, one object of the present invention is to provide an infant head support pillow which is light in weight and which effectively supports a baby's head in an upright position.

Yet another object of the present invention is to provide an infant head support pillow which is both safe and economical.

Still another object of the present invention is to provide a infant head support pillow which is comfortable to a baby and conforms to the baby's neck and head.

These and other valuable objects and advantages of the present invention are provided by an infant head support pillow having a top half and a bottom half which form the exterior of the pillow. A filler-cushion material contacts the top half and the bottom half and is positioned in the interior of the pillow between the top and bottom halves.

The infant head support pillow is formed by a first longitudinal side, a second longitudinal side, and by a first latitudinal side and a second latitudinal side which are formed by the top and bottom halves. The second longitudinal side has a first keyhole wing and a second keyhole wing which curve inward in the direction of the first longitudinal side so as to make an opening between the first keyhole wing and the second keyhole wing. The second longitudinal side forms a keyhole region at the center of the infant head support pillow with the first and second keyhole wings being substantially parabolic in shape and defining a portion of the keyhole region. The first keyhole wing has a curved configuration which projects toward the second latitudinal side. The second keyhole wing has a curved configuration which projects toward the first latitudinal side. The curved configurations of the first and second keyhole wings are in substantial contact with one another but can be spread apart and made separable due to the flexible nature of the infant head support pillow. The diameter of the keyhole region is approximately one-fourth the distance between the first and second latitudinal sides. The infant head support pillow of the present invention has a one-piece finished product construction.

BRIEF DESCRIPTION OF THE DRAWINGS

A more complete appreciation of the invention and many of the attendant advantages thereof will be readily obtained as the same becomes better understood by reference to the following detailed description with the accompanying drawings, wherein.

When referring to the drawings, it should be understood that like reference numerals designate identical or corresponding parts throughout the respective figures.

THE DETAILED DESCRIPTION OF THE INVENTION

Figure 1:
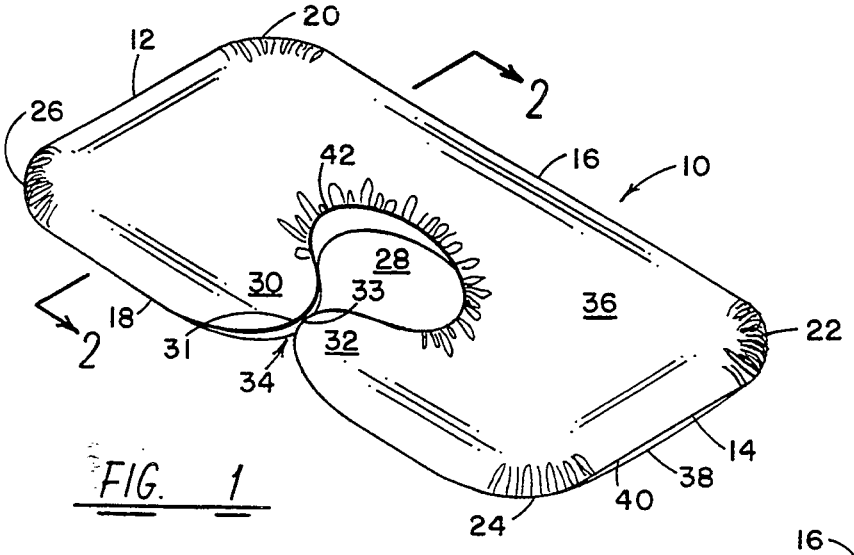
FIG. 1 is a perspective view of the infant head support pillow according to the present invention.

With reference to FIG. 1, the infant head support pillow 10 of the present invention has a substantially rectangular shape which is defined by its latitudinal sides 12 and 14 and by its longitudinal sides 16 and 18. The longitudinal sides 16 and 18 are longer in length than latitudinal sides 12 and 14. The infant head support pillow 10 is further provided with four 90° tapered and rounded corners 20, 22, 24, and 26, respectively which are connected to the sides 12, 14, 16 and 18.

At the center of longitudinal side 18, the pattern of the infant pillow head support 18 curves in the direction of latitudinal side 16 to form keyhole wings 30 and 32, respectively The keyhole wings 30 and 32 contribute to defining the periphery 42 of a keyhole region 28. The keyhole region 28 is positioned in the center of the infant pillow head support 10 and is located equidistant from latitudinal sides 12 and 14 and has a diameter approximating one-fourth of the distance between latitudinal sides 12 and 14. Keyhole wings 30 and 32 form an opening 34 which allows access to the keyhole region 28. Keyhold wings 30 and 32 are substantially parabolic in shape. The vertex region 31 of keyhole wing 30 is oriented toward latitudinal side 14 and the vertex region 33 of keyhole wing 32 is oriented toward the latitudinal side 12 such that vertex region 31 of keyhole wing 30 and vertex region 33 of keyhole wing 32 come into substantial contact with one another. Due to the flexible nature of the infant head support pillow 10, vertex region 31 and vertex region 33 can be pulled apart and separated. A sewing seam 40 which extends along the entire length of latitudinal sides 12 and 14, longitudinal sides 16 and 18 and the periphery of the keyhole region 28 connects identical top and bottom halves 36 and 38, respectively.

Figure 2:
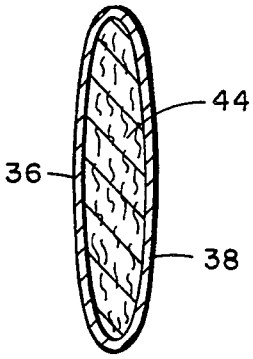
FIG. 2 is a cross-sectional illustration taken along line II—II of FIG. 1.

The cross sectional illustration of FIG. 2 which is taken along line II—II of FIG. 1 demonstrates that the interior of the infant head support pillow 10 is filled with a filler-cushion material 44. In the prototype of the present invention, the filler-cushion material 44 was a single-piece, layered polyester fiber batting which was cut to the pattern specifications of the infant head support pillow 10. Alternative materials could be substituted for polyester fiber batting but such materials must be light in weight and have similar material characteristics so as to make the assembled infant head support pillow 10 flexible and somewhat elastic.

Figure 3:
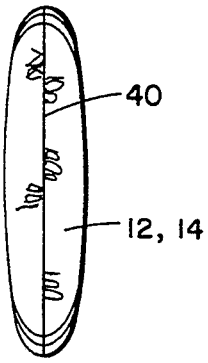
FIG. 3 is a side-view of the infant head support pillow of the present invention.

FIG. 3 is a side-view illustration depicting latitudinal sides 12 and 14 of the infant head support pillow 10 of the present invention. FIG. 3 demonstrates that sewing seam 40 extends along the latitudinal sides 12 and 14 separates the top half 36 from the bottom half 38.

Figure 4:
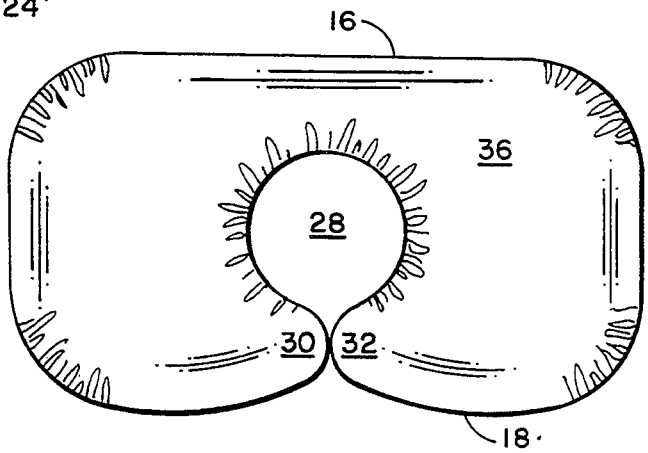
FIG. 4 is a top view of the infant head support pillow of the present invention.
Figure 5:
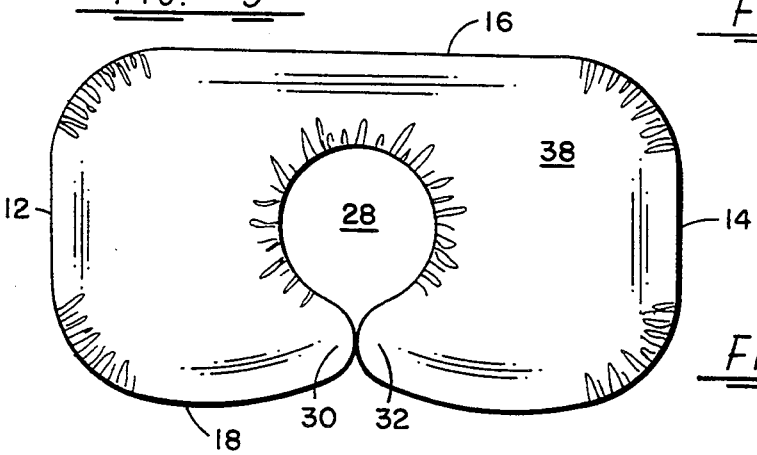
FIG. 5 is a bottom view of the infant head support pillow of the present invention.

FIG. 4 and FIG. 5 demonstrate that the top half 36 and bottom half 38 of the infant head support pillow 10 are identical.

Figure 6:
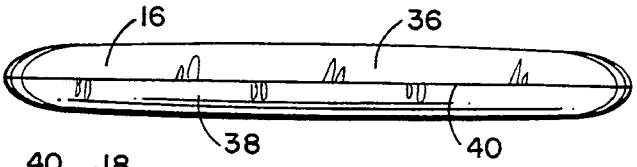
FIG. 6 is a posterior view of the infant head support pillow of the present invention.

FIG. 6 demonstrates that the sewing seam 40 extends along the entire length of longitudinal side 16 so as to connect top half 36 with bottom half 38 of the infant head support pillow 10 of the present invention.

Figure 7:
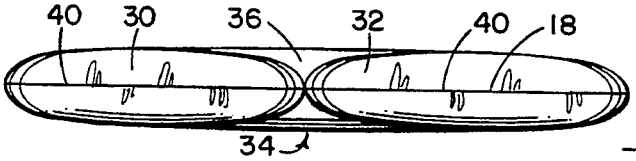
FIG. 7 is a frontal view of the infant head support pillow of the present invention.

FIG. 7 is a front view illustration of the infant head support pillow of the present invention and demonstrates that the sewing seam 40 extends along the longitudinal side 18.

Figure 8:
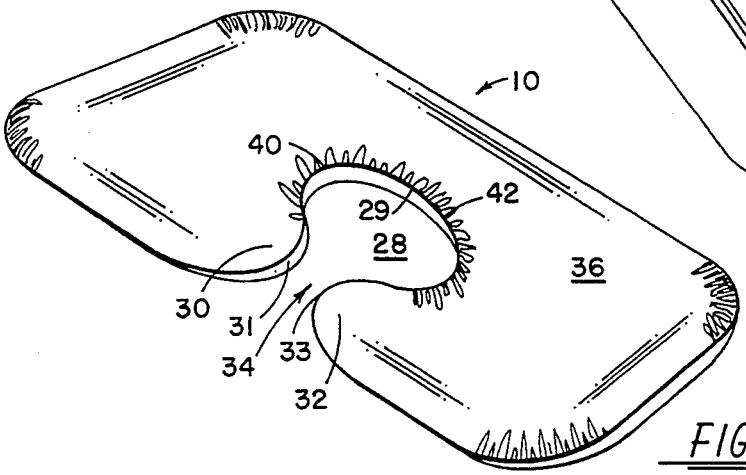
FIG. 8 is a perspective view which demonstrates the flexible nature of the infant head support pillow of the present invention.

FIG. 8 is a perspective view of the infant head support pillow of the present invention. Keyhole wings 30 and 32 are pulled apart for illustrative purposes to demonstrate the flexible nature of the infant pillow head support 10 of the present invention and the fact that the vertex region 31 of keyhole wing 30 can be spaced apart and made separable from the vertex region 33 of keyhole wing 32. FIG. 8 further serves to demonstrate that the sewing seam 40 extends around the periphery 42 of the keyhole region 28.

Figure 9:
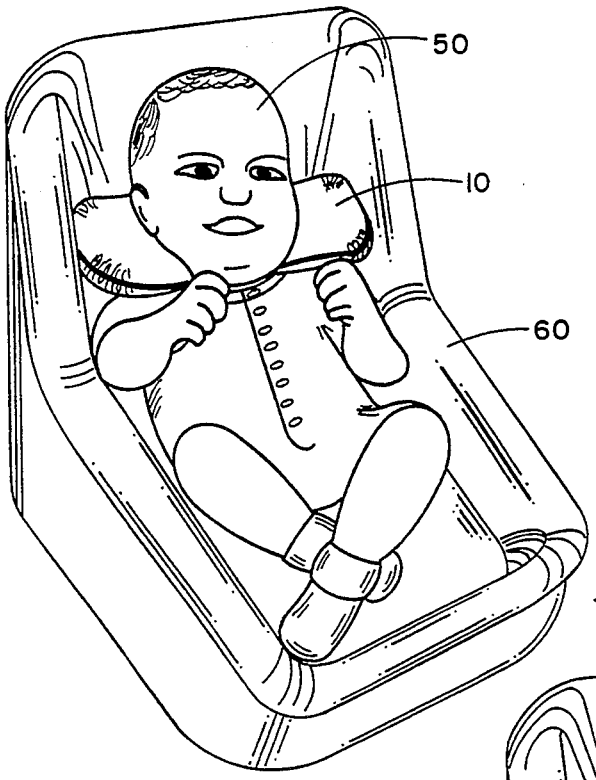
FIG. 9 is an exemplary illustration depicting a baby in a car seat using the infant head support pillow of the present invention.

FIG. 9 is an exemplary illustration which demonstrates the infant head support pillow of the present invention being used by an infant 50 in a car seat 60. The infant head support pillow 10 maintains the infant's head in an upright position.

Figure 10:
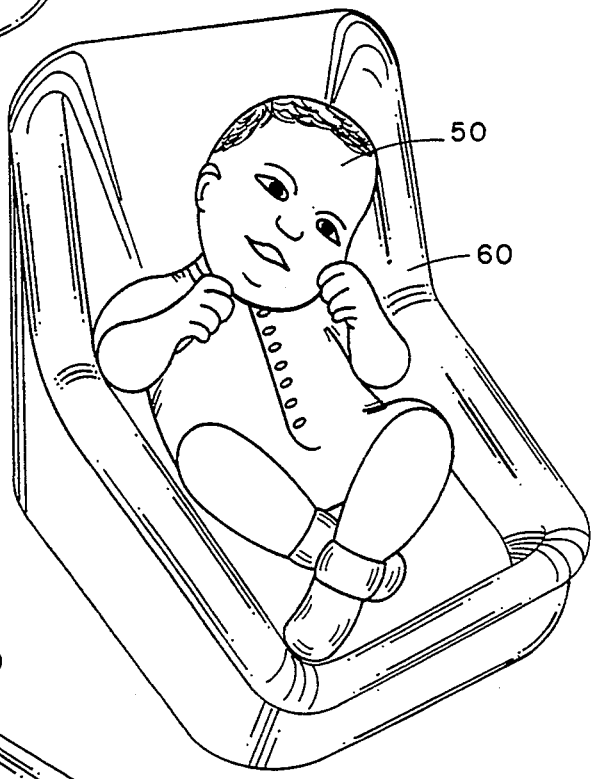
FIG. 10 is an exemplary illustration of a baby in a car seat without the infant support pillow of the present invention.

The upright position of the infant's 50 head shown in FIG. 9 is contrasted by the angled position of the infant's 50 head shown in FIG. 10 where the infant is without the benefit of the infant head support pillow 10 of the present invention. FIG. 10 serves to give the reader an appreciation for the ease with which an infant's head flops from side to side and up and down with the slightest impetus of force.

The infant head support pillow 10 of the present invention is therefor comprised of an upper half 36 and lower half 38 which are sewn together to cover the filler-cushion material 44 so as to result in a one-piece, finished-product construction.

The infant head support pillow 10 of the present invention has been designed especially for infants ranging from birth to five months of age. The purpose of the pillow is to provide support for an infant's head and to protect against cramping and stretching of an infant's developing neck muscles. The infant pillow head support 10 is sized to be used with commercial car seats, infant carriers, strollers, swings or anywhere the infant will be subjected to enough movement to cause the head to drop onto the shoulder. Further, the infant head support pillow 10 provides head and neck support to an infant while the infant is being held or carried by an individual.

In the prototype of the present invention, the rectangular dimensions of the infant head support pillow 10 were patterned as being 9 inches long by 5.3 inches wide, with a thickness of 1.2 inches. Thus, the longitudinal side 16 had a length of 9 inches and the latitudinal sides each had lengths of 5.3 inches. In that the infant head support pillow 10 is designed specifically for infants, the above-noted dimensions should not vary by a tolerance of more than 15%.

The top half 36 of the infant head support pillow 10 is the side of the pillow 10 which contacts the infant's face. In the prototype of the present invention, the top half 36 of the infant head support pillow 10 was made of stretchable terry cloth which was selected for its durable, strong, soft and washable characteristics. The bottom half 38 of the prototype of the infant head support pillow 10 of the present invention was made of a cotton blend fabric.

To properly use the infant head support pillow 10, the keyhole wings 30, 32 are pulled apart and the posterior peripheral region 29 of the keyhole region 28 is placed in contact with the with the back of the infant's head at a location half-way up the back of the head (see FIG. 9). The infant head support pillow 10 is then sloped at a 45% angle towards the infant's jaw line, the frontal gap realized by the opening 34 between the keyhole wings is typically 2½ inches so that in no circumstances would the keyhole wings 30, 32 close over the infant's throat.

The keyhole wings 30, 32 can be spread to accommodate any infant neck size, and when positioned on the infant, the soft, pliable and flexible nature of the infant head support pillow 10 conforms to the infant's shape giving the infant comfortable albeit effective head support. Further, the size, shape and materials used in the infant head support pillow 10 of the present invention remove any worry as to accidental suffocation of the infant.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. An infant head support pillow having a one-piece, finished-product construction, comprising:

a top half;

a bottom half connected to said top half, said top half and said bottom half forming the exterior of said infant head support pillow;

a filler-cushion material contacting said top half and said bottom half and positioned in the interior of said infant head support pillow between said top half and said bottom half;

a first longitudinal side formed by said top half and said bottom half;

a first latitudinal side and a second latitudinal side formed by said top half and bottom half;

a first keyhole wing having a curved configuration which projects in the direction of said second latitudinal side and curves inward in the direction of said first longitudinal side;

a second keyhole wing having a curved configuration which projects in the direction of said first latitudinal side and curves inward in the direction of said first longitudinal side, said curved configuration of said first keyhole wing and said curved configuration of said second keyhole wing come into substantial contact with each other and define an opening therebetween;

a second longitudinal side comprised of said first keyhole wing and said second keyhole wing and forming a keyhold region at the center of said infant head support pillow, said second longitudinal side being formed of said top half and said bottom half;

wherein said curved configuration of said first keyhole wing and said curved configuration of said second keyhole wing are separable due to the flexible nature of said infant head support pillow; and said infant head support pillow is nine inches long and has a thickness of 1.2 inches with a tolerance of 15%.

2. An infant head support pillow according to claim 1, wherein:

the diameter of said keyhole region is approximately one-fourth of the distance between said first latitudinal side and said second latitudinal side.

3. An infant head support pillow according to claim 1, wherein :

said filler-cushion material is a single piece of layered polyester fiber batting cut to the pattern of said infant pillow head support pillow.

4. An infant head support pillow according to claim 1 wherein said infant head support pillow is substantially rectangular in shape.

5. An infant head support pillow according to claim 1, wherein the filler-cushion material is soft, flexible and pliable so that the periphery of the keyhole which is formed by said second longitudinal side conforms to the neck size of an infant.

6. An infant head support pillow according to claim 1, wherein:

said infant head support pillow has a width of 5.3 inches with a tolerance of 15%.

7. An infant head support pillow having a one-piece, finished-product construction, comprising:

a top half;

a bottom half connected to said top half, said top half and said bottom half forming the exterior of said infant head support pillow;

a filler-cushion material positioned in the interior of said infant head support pillow between said top half and said bottom half;

a first longitudinal side formed by said top half and said bottom half;

a first latitudinal side and a second latitudinal side formed by said top half and bottom half;

a first keyhole wing substantially parabolic in shape and having a vertex region oriented toward said second latitudinal side;

a second keyhole wing substantially parabolic in shape and having a vertex region oriented toward said first latitudinal side such that said vertex region of said second keyhole wing and said vertex region of said first keyhole wing come into substantial contact with each other and define an opening therebetween;

a second longitudinal side comprised of said first keyhole wing and said second keyhole wing and forming a keyhole region at the center of said infant head support pillow, said second longitudinal side being formed of said top half and bottom half;

wherein said vertex region of said first keyhole wing and said vertex region of said second keyhole wing are separable due to the flexible nature of said infant head support pillow; and said infant head support pillow is nine inches long and has a thickness of 1.2 inches with a tolerance of 15%.

8. An infant head support pillow according to claim 7, wherein:

said infant head support pillow has a width of 5.3 inches with a tolerance of 15%.

* * * * *